United States Patent [19]

Kitaoka et al.

[11] Patent Number: 4,799,204

[45] Date of Patent: Jan. 17, 1989

[54] ALARM STOP DEVICE FOR A TIMEPIECE

[75] Inventors: Seiya Kitaoka; Masao Hanya, both of Tokyo, Japan

[73] Assignee: Seikosha Co., Ltd., Tokyo, Japan

[21] Appl. No.: 186,284

[22] Filed: Apr. 26, 1988

[30] Foreign Application Priority Data

Apr. 27, 1987 [JP] Japan ..... 61-63794[U]

[51] Int. Cl.[4] ..... G04B 23/00

[52] U.S. Cl. ..... 368/263; 368/74

[58] Field of Search ..... 368/72–74, 368/243, 244, 248, 250, 262, 263

[56] References Cited

U.S. PATENT DOCUMENTS 4,228,645 10/1980 Nomura ..... 368/75

4,307,460 12/1981 Polonsky ..... 368/74

4,423,966 1/1984 Ogihara et al. ..... 368/263

*Primary Examiner*—Vit W. Miska

*Attorney, Agent, or Firm*—Bruce L. Adams; Van C. Wilks

[57] ABSTRACT

An alarm stop device of a timepiece comprising:

a slideable alarm stop lever;

an alarm stop switch actuatable by alarm stop lever an engagement element provided on the alarm stop lever;

a control element which allows depression of such engagement element when said alarm stop switch is operative, and which inhibits depression of the engagement element when the alarm stop switch is not operative; and a snooze switch which can be opened and closed by depressing the alarm stop lever.

1 Claim, 2 Drawing Sheets

ALARM STOP DEVICE FOR A TIMEPIECE

The present utility model relates to an alarm stop stop device of a timepiece.

Conventional alarm stop devices of timepieces are arranged such that an alarm stop switch is opened and closed by means of an alarm stop lever, with an additional snooze switch being provided separate from the alarm stop switch. The snooze switch can be opened and closed irrespective of whether said alarm stop switch is opened or closed.

However, there is a problem in that a certain circuit arrangement of the timepiece may cause a consumption of electric power when the alarm stop switch is opened with the snooze switch closed. Particularly in the case of a portable thin clock which can be kept, for example, in an inner pocket of a business suit, unnecessary closures of the snooze switch may accidentally arise within the pocket, consuming electricity uselessly. Moreover, because the snooze switch, as desired previously, can be opened and closed irrespective of whether the alarm stop switch is opened or closed, a mere touching on the alarm stop lever does not allow the determination of whether the alarm stop switch is in the opened or closed state.

An object of the present utility model is therefore to provide an alarm stop device of a timepiece in which the opening and closing of its snooze switch can be controlled depending on the opened and closed states of its alarm stop switch in order to avoid unnecessary consumption of electric power, and in which a mere touching on its alarm stop lever allows the determination with ease of whether the alarm stop switch is in the opened or closed state.

The present utility model is characterized in that a slidable alarm stop lever is provided, that an alarm stop switch is arranged such that it is opened and closed by means of the sliding movement of said alarm stop lever, that an engagement element is provided on the alarm stop lever, that a control element is provided which allows or prohibits the depression of the engagement element (depression in the direction transverse to the sliding direction of the alarm stop lever) depending on the operative and non-operative condition of the alarm stop switch respectively, that the depression of the alarm stop lever is thus controlled by the control element, and that the snooze switch is arranged such that it can be closed when the depression is allowed.

Thus, when the alarm stop lever is in the position in which it allows the operation of the alarm stop switch, the control element allows the depression of the alarm stop lever so that the snooze switch can be opened and closed by the depressing action.

Further, when the alarm stop lever is slid to place the alarm stop switch in the non-operative condition, the alarm stop lever cannot be depressed and therefore the snooze switch cannot be opened or closed.

12 . . . control element (groove);

2 . . . alarm stop lever;

**22*a*** . . . engagement element;

3 . . . alarm stop switch; and

9 . . . snooze switch.

Figure 1:
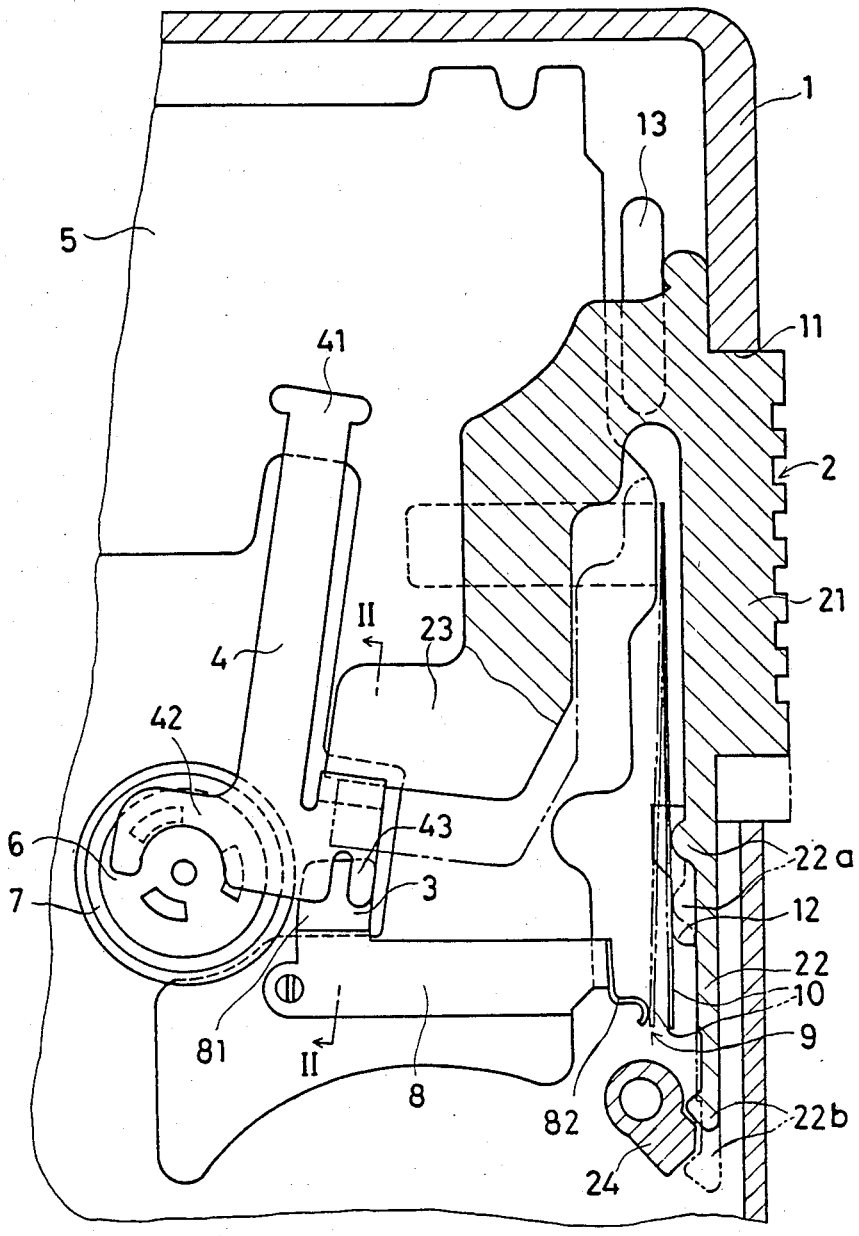
FIG. 1 is a plan view showing the condition with the upper case being removed.

An embodiment of the present utility model will hereinafter be described on the basis of the drawings. FIG. 1 shows the condition with an upper case being removed, a lower case 1 is provided with a window 11 in a peripheral portion thereof, in which the window a grip 21 of an alarm stop lever 2 is slidably fitted.

The alarm stop lever 2 is configured such that an extension portion 22 extends below the grip 21, this extension portion having integrally formed therewith an engagement element **22*a* on its base and a projection 22*b* for clicking on its lower end. It also has an actuation piece 23 integrally formed therewith, such actuation piece extends to the left of the grip 21 and is adapted to open and close an alarm switch 3. Numeral 24 is a clicking projection which engages with a clicking bump 22*b*** to form a clicking mechanism.

Next, a description will be given with respect to the construction of the alarm stop switch 3.

A raised spring 4 has a base end 41 soldered to a circuit pattern (not shown) on a printed circuit board 5, and the tip 42 of the raised spring 4 is elastically touched an alarm gear 6 on the upper surface. An hour gear 7 is provided coaxially with the alarm gear 6 in a well known manner such that these alarm gear and hour gear come to contact with each other at the alarm set time. To this end, a contact piece 43 provided on the tip of the raised spring 4 is adapted for contact with an end 81 of a connecting body 8 fixed to the lower case 1. At the other end of the connecting body 8, there is integrally formed a contact piece 82 which constitute one element of a snooze switch 9, this contact piece being adapted to come into and out of contact with the other snooze contact piece 10 of the snooze switch 9.

The snooze contact piece 10 is fixed in a manner in which it is connected to the circuit pattern on the printed circuit board 5.

Bringing into and out of mutual contact of the snooze contact piece 10 and the contact 82 which together form the snooze switch 9 is performed by depressing the grip 21 of the alarm stop lever 2 in the direction perpendicular to the sliding direction of such alarm stop lever. The depression of the alarm stop lever 2, however, is controlled by means of a groove 12 which is a control element. That is, the groove 12 which is formed in the lower case 1 is wider in the upper half thereof and narrower in the lower half thereof. The snooze contact piece 10 is located to overlap with the groove 12 as seen in the planar direction, and the engagement element **22*a* is adapted to move up and down within the region of the groove 12 with the alarm stop lever 2 sliding up and down. Thus, when the alarm stop lever 2 is positioned upwardly and the engagement element 22*a* is positioned in the upper half of the groove 12, the wider width of such groove allows the alarm stop lever 2 to be depressed to the left, but when the alarm stop lever 2 has been slid downwardly and the engagement element 22*a* has been positioned in the lower half of the groove 12**, then the depression to the left is impossible.

Furthermore, a guide 13 is formed in the lower case 1, which guides the alarm stop lever 2 in the sliding direction.

Next, a description will be given with respect to the operation of the device.

The position shown in a solid line in FIG. 1 is in the alarm set condition. At the alarm set time, the contact piece 43 of the raised spring 4 comes into contact with the end 81 of the connecting body 8, as shown in FIG.

2, causing an alarm sound. At that time, the engagement element 22a of the alarm stop lever 2 is positioned in the upper wider half of the groove 12 so that the grip 21 of the alarm stop lever 2 can be depressed to the left in FIG. 1. The snooze contact piece 10 then comes into contact with the contact piece 82, thereby closing the snooze switch 9.

Figure 2:
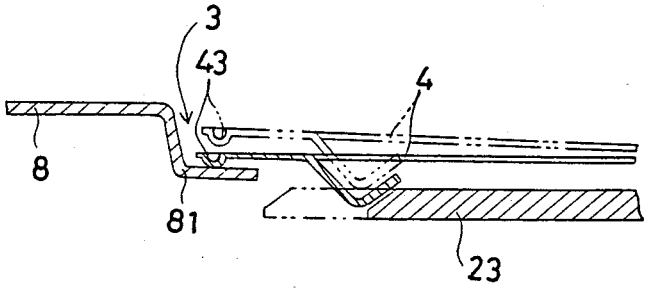
FIG. 2 is an enlarged cross section view along lines II—II in FIG. 1.

With the alarm stop lever 2 being slid downwardly to the position as shown in broken lines in FIG. 1, the actuating piece 23 of the alarm stop lever will raise the raised spring 4 as shown in FIG. 2 so that the contact piece 43 is removed away from the end 81 of the connecting body 8, whereby a permanent alarm stop condition is achieved.

Under such circumstances, the engagement portion 22a is located in the lower narrower half of the groove 12, so that the depression of the grip 21 of the alarm stop lever in the leftward direction is inhibited by the groove 12 and is thus impossible. The snooze contact piece 10, therefore, cannot be brought into contact with the contact piece 82 of the snooze switch 9.

As described above, according to the present utility model, the depression of the alarm stop lever is impossible with the alarm stop switch being non-operative, whereby it is possible to avoid excess electric power consumption. Moreover, the alarm set condition and the alarm stop condition may easily be discriminated from each other depending on whether the depression of the alarm stop lever is possible or not.

What is claimed is:

1. An alarm stop device of a timepiece comprising:

a slidable alarm stop lever;

an alarm stop switch actuatable by said alarm stop lever;

an engagement element provided on said alarm stop lever;

a control element which allows depression of such engagement element when said alarm stop switch is operative, and which inhibits depression of said engagement element when said alarm stop switch is not operative; and a snooze switch which can be opened and closed by depressing said alarm stop lever.

* * * * *